US008396384B2

(12) United States Patent
Hayashihara et al.

(10) Patent No.: US 8,396,384 B2
(45) Date of Patent: Mar. 12, 2013

(54) APPARATUS AND METHOD OF DETERMINING THE TYPE OF PAPER SHEET, AND IMAGE FORMATION APPARATUS

(75) Inventors: Hiromichi Hayashihara, Kawasaki (JP); Masataka Shiratsuchi, Kawasaki (JP); Takeshi Morino, Yokohama (JP); Hiroshi Ohno, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 13/209,628

(22) Filed: Aug. 15, 2011

(65) Prior Publication Data

US 2012/0027483 A1 Feb. 2, 2012

Related U.S. Application Data

(63) Continuation of application No. PCT/JP2010/052451, filed on Feb. 18, 2010.

(30) Foreign Application Priority Data

Feb. 18, 2009 (JP) ..... 2009-035265

(51) Int. Cl.
*B65H 7/14* (2006.01)
*G03G 15/00* (2006.01)

(52) U.S. Cl. ..... 399/45; 399/389

(58) Field of Classification Search ..... 399/45, 399/389; 356/630, 632; 250/559.28, 559.27
See application file for complete search history.

(56) References Cited

U.S. PATENT DOCUMENTS

| | | | | |
|---|---|---|---|---|
| 5,764,367 | A | 6/1998 | Schaede et al. | |
| 6,335,084 | B1 * | 1/2002 | Biegelsen et al. | 428/192 |
| 6,636,704 | B2 | 10/2003 | Weaver et al. | |
| 7,885,597 | B2 * | 2/2011 | Gast et al. | 399/389 |
| 8,023,843 | B2 * | 9/2011 | Degruchy et al. | 399/45 |
| 2004/0251599 | A1 * | 12/2004 | Kojima et al. | 271/147 |
| 2006/0215195 | A1 * | 9/2006 | Chan | 358/1.9 |
| 2008/0175606 | A1 | 7/2008 | Okada | |
| 2009/0086217 | A1 | 4/2009 | Hayashihara et al. | |
| 2009/0103934 | A1 * | 4/2009 | Murakami | 399/45 |
| 2011/0020021 | A1 * | 1/2011 | Murakami | 399/45 |

FOREIGN PATENT DOCUMENTS

| | | |
|---|---|---|
| JP | 07-196207 | 8/1995 |
| JP | 2003-081486 | 3/2003 |
| JP | 2003-212391 | 7/2003 |
| JP | 2003-212392 | 7/2003 |
| JP | 2003-226447 | 8/2003 |

(Continued)

OTHER PUBLICATIONS

International Search Report for International Application No. PCT/JP2010/052451 mailed on Mar. 23, 2010.
Japanese Office Action for Japanese Application No. 2009-035265 mailed on Jun. 19, 2012.

*Primary Examiner* — Daniel J Colilla
(74) *Attorney, Agent, or Firm* — Turocy & Watson, LLP

(57) ABSTRACT

According to one embodiment, a sheet type determination apparatus includes a tray, light source, detection unit, database, and operation unit. The tray is configured to hold a sheet bundle formed by stacked sheets. The light source emits illumination light to a first region. The detection unit detects a light intensity distribution of transmitted light emerging from a second region. The transmitted light is generated as the illumination light passes through the sheet bundle, and the second region is different from the first region. The database stores a table describing a relation between reference attenuation rates and types. The operation unit is configured to calculate an attenuation rate of the transmitted light based on the light intensity distribution, and determine a type of the sheets by comparing the attenuation rate with the reference attenuation rates.

10 Claims, 16 Drawing Sheets

FOREIGN PATENT DOCUMENTS

| | | |
|---|---|---|
| JP | 2003-300648 | 10/2003 |
| JP | 2004-315210 | 11/2004 |
| JP | 2005-104723 | 4/2005 |
| JP | 2005-114866 | 4/2005 |
| JP | 2008-083689 | 4/2008 |
| JP | 2009-096638 | 5/2009 |

* cited by examiner

| Sheet Type | Attenuation Rate of Transmitted Light | Density (g/cm$^3$) |
|---|---|---|
| Standard paper 1 | A11~A12 | B11~B12 |
| Standard paper 2 | A21~A22 | B21~B22 |
| Heavy paper 1 | A31~A32 | B31~B32 |
| Heavy paper 2 | A41~A42 | |
| Heavy paper 3 | A51~A52 | B41~B42 |
| Heavy paper 4 | A61~A62 | |

| Sheet Type | Grammage (g/m$^2$) | Target Fixing Temperature (℃) | Sheet Converyance Speed (mm/s) |
|---|---|---|---|
| Standard paper 1 | C11~C12 | D11~D12 | E1 |
| Standard paper 2 | C21~C22 | D21~D22 | |
| Heavy paper 1 | C31~C32 | D31~D32 | E2 |
| Heavy paper 2 | C41~C42 | D41~D42 | |
| Heavy paper 3 | C51~C52 | D51~D52 | E3 |
| Heavy paper 4 | C61~C62 | D61~D62 | |

APPARATUS AND METHOD OF DETERMINING THE TYPE OF PAPER SHEET, AND IMAGE FORMATION APPARATUS

CROSS REFERENCE TO RELATED APPLICATIONS

This application is a Continuation Application of PCT Application No. PCT/JP2010/052451, filed Feb. 18, 2010 and based upon and claiming the benefit of priority from prior Japanese Patent Application No. 2009-035265, filed Feb. 18, 2009, the entire contents of all of which are incorporated herein by reference.

FIELD

Embodiments described herein relate generally to a sheet type determination apparatus, a sheet type determination method, and an image formation apparatus including the sheet type determination apparatus.

BACKGROUND

An image formation apparatus such as the laser printer generally forms images on paper sheets, which are paper-like media of various types being different in character from each other, such as heavy paper, copy paper, OHP films. In such an image formation apparatus, the various conditions of the printing/fixing process may be optimized in accordance with the type of each paper sheet to be used, in order to form images of high quality. To optimize the various conditions of the printing/fixing process, the apparatus needs parameter data on the type of a paper sheet, such as the thickness, density and grammage. Hitherto known is an image formation apparatus including a console panel, which the user may operate to designate the type of a paper sheet. In recent years, a sensor called "media sensor" has come into use. The media sensor automatically determines the type of a paper sheet. In any image formation apparatus that includes such a sensor, the type of a paper sheet is determined without the user's manual operation, whereby the conditions of forming images are optimized.

Various methods of determining the type of a paper sheet have been proposed for use in image formation apparatuses. JP-A 7-196207 (KOKAI) discloses a method in which a sensor unit provided on a conveyance path applies light to every paper sheet being conveyed and measures the thickness and density of the paper sheet based on the light transmittance of the paper sheet, whereby to determine the type of the paper sheet. In this method, the type of any paper sheet is determined after the conveyance of the paper sheet has been started. However, if the type of any paper sheet is determined after the start of paper sheet conveyance, the conditions of the printing/fixing process, such as the temperature of the fixing drum, cannot be set in time because the speed of forming images has increased in recent years.

JP-A 2003-226447 (KOKAI) and JP-A 2005-104723 (KOKAI) disclose methods, in which the data, such as the thickness of each of paper sheets, is acquired before the paper sheets are conveyed, or while the paper sheets remain in the sheet feed tray of the image formation apparatus. In the method disclosed in JP-A 2003-226447 (KOKAI), one side surface of a pile of paper sheets which are stacked is imaged, an inter-peak distance in the waveform with the unevenness defined by the paper sheets is then calculated, and the thickness of each paper sheet is calculated. In this case, a light source that operates in unison with an image sensor applies illumination light to the side surface slantwise from above or below in order to accentuate the subtle irregularities on the side surface of the pile of the paper sheets. In the method disclosed in JP-A 2005-104723 (KOKAI), a waveform with the unevenness in one side surface of a pile of paper sheets is acquired in the same way, and a frequency analysis such as fast Fourier transform is performed to calculate the thickness of each paper sheet.

These methods, in which a side surface of a pile of paper sheets is merely imaged, can provide only data, e.g., the thickness of each paper sheet and the number of paper sheets. In order to find the grammage of each paper sheet, it is required to detect the density of the paper sheet in addition to the thickness of the paper sheet.

As described above, in the method of JP-A 7-196207 (KOKAI), the conditions important in printing, such as the temperature of the fixing drum, cannot be set in time because the type of any paper sheet is determined after the start of paper sheet conveyance. In the methods of JP-A 2003-226447 (KOKAI) and JP-A 2005-104723 (KOKAI), the type of paper sheets can be determined while the paper sheets remain in the sheet feed tray, but the data acquired is only about the thickness of each paper sheet and the number of paper sheets.

In the image formation apparatus, it is required to acquire parameter data, such as not only the thickness of each paper sheet but also the grammage thereof and determine the type of the paper sheet for forming an image of high quality on the paper sheet.

Therefore, in a method of determining the type of a paper sheet, it is required to reliably determine the type of the paper sheet at high precision.

DETAILED DESCRIPTION

Figure 1:
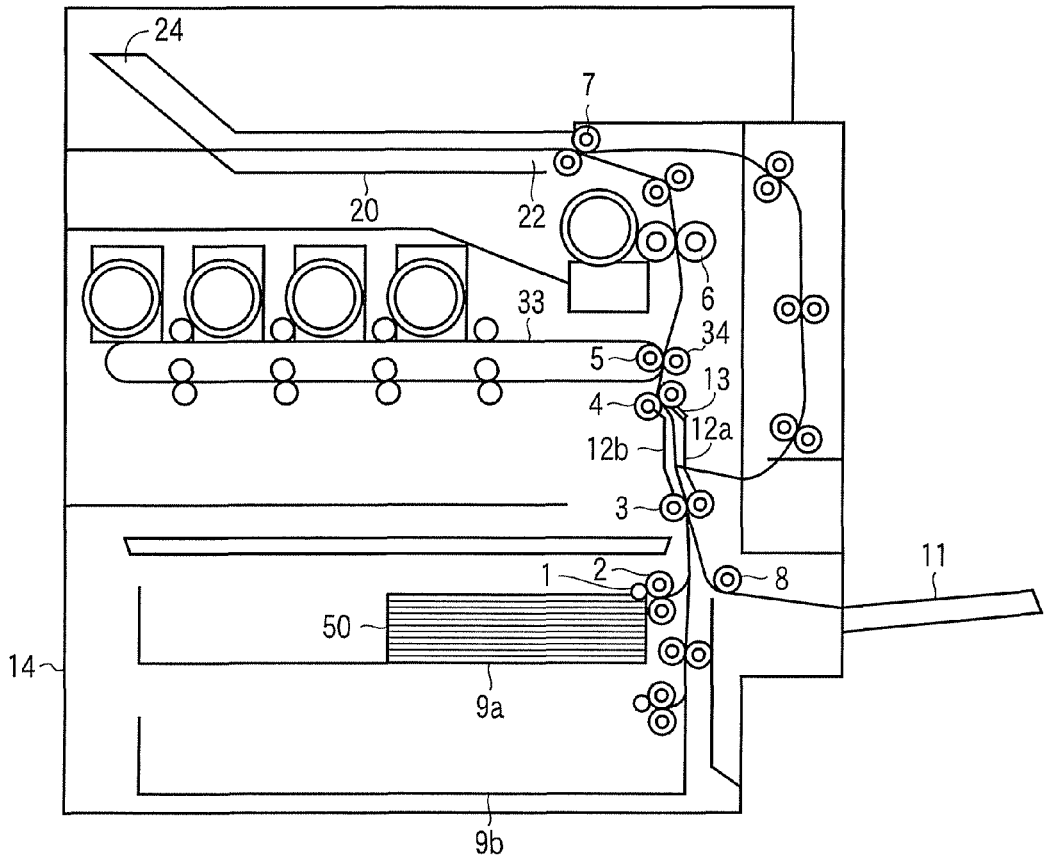
FIG. 1 is a schematic diagram showing an exemplary image formation apparatus in which a sheet type determination apparatus according to an embodiment is utilized.

In general, according to one embodiment, a sheet type determination apparatus includes a tray, light source, detection unit, database, and operation unit. The tray is configured to hold a sheet bundle formed by sheets which are stacked. The sheet bundle includes an upper surface, a lower surface and a plurality of side surfaces extending in a stacking direction. The light source is configured to emit illumination light to a first region on at least one first surface selected from the upper surface, the lower surface and the side surfaces. The detection unit is configured to detect a light intensity distribution of transmitted light emerging from a second region on at least one second surface selected from the upper surface, the lower surface and the side surfaces. The transmitted light is generated as the illumination light passes through the sheet bundle, and the second region is different from the first region. The database is configured to store a table describing a relation between reference attenuation rates and sheet types. The operation unit is configured to calculate an attenuation rate of the transmitted light based on the light intensity distribution, and determine a type of the sheets by comparing the attenuation rate with the reference attenuation rates.

Hereinafter, a sheet type determination apparatus according to one embodiment, which determines the type of a paper sheet, will be described with reference to the accompanying drawings. The components and items of one embodiment, which are identical to those of any other embodiment, are designated by the same reference numerals in FIGS. 1 to 18, and will not be described again, once they have been described in detail. In describing the embodiments, the paper sheet will be called "sheet" for simplicity of explanation. The word "sheet" means not only a sheet of paper but also a paper-like medium made of any material other than paper. When the sheet mentioned herein, such a paper-like medium is included.

FIG. 1 schematically shows the arrangement of an image formation apparatus in which a sheet type determination apparatus according to an embodiment is utilized. Sheet feed trays 9*a* and 9*b*, holding sheets 50 on which images will be formed, are provided in a housing 14 shown in FIG. 1. On the housing 14, a manual feeding tray 11 is provided for feeding sheets. A pickup roller 1 picks up one sheet 50 after another from the sheet feed trays 9*a* and 9*b*. The sheet 50 is then conveyed to a conveyance path by sheet feeding rollers 2. A sheet feeding roller 8 takes one sheet 50 after another to the conveyance path from the manual feeding tray 11.

The sheet 50 so fed is conveyed by an intermediate conveyance roller pair 3, along conveyance guides 12*a* and 12*b* which defines the conveyance path, then guided by a registration guide 13 to a registration roller pair 4, and conveyed a secondary transfer unit 5 which is an image transfer unit. At the secondary transfer unit 5, an image is transferred to the sheet 50 in accordance with image data. A full-color toner image depending on image data is formed on a transfer belt 33, and is transferred from the belt 33 to the sheet 50 at the secondary transfer unit 5. The transfer to the sheet 50 is carried out, at a nip where the transfer belt 33 and a secondary transfer roller 34 are in contact to electrically adsorb toner on the surface of the sheet 50, by applying a transfer bias to the secondary transfer roller 34.

The toner image transferred onto the sheet 50 only adheres to the sheet 50 in the form of powder with a feeble force in this state and may easily peel off from the surface of the sheet 50. In order to prevent such peeling, the toner image is fixed in the next step. That is, the sheet 50 to which the toner image has been transferred is conveyed to a fixing roller pair 6 heated by a halogen heater or an electromagnetic heating system. When the sheet 50 is nipped and conveyed by the fixing roller pair 6, the toner on the surface of the sheet 50 is melted due to heating/pressure and pressed against the surface of the sheet 55 by pressure. As a result, the toner image on the sheet 50 is fixed as a semi-permanent image.

The sheet 50, on which the image formed, is conveyed by a delivery roller pair 7 to a delivery tray 20 that includes an inlet port 22 and an outlet port 24. The sheet 50 enters the delivery tray 20 through the inlet port 22 and ejected from the delivery tray 20 through the outlet port 24.

In the image formation apparatus shown in FIG. 1, the various conditions on the image formation process may be optimized in accordance with the type of the sheet 50 in order to stably form a high-quality image on the sheet 50. These conditions are the parameter values such as the speed of conveying the sheet (sheet conveyance speed), the pressure at which the conveyance rollers nip the sheet, the transfer bias applied to the secondary transfer roller 34, and the temperature at the fixing roller pair 6.

A sheet type determination apparatus according to an embodiment not only determines the type of each sheet 50, but also calculates the thickness and grammage of the sheet 50, while the sheet 50 remains held in sheet feed tray 9*a* or 9*b*. Moreover, the type of each sheet 50 and the thickness and grammage thereof are determined, also while the sheet 50 remains on the manual feeding tray 11.

(First Embodiment)

Figure 2:
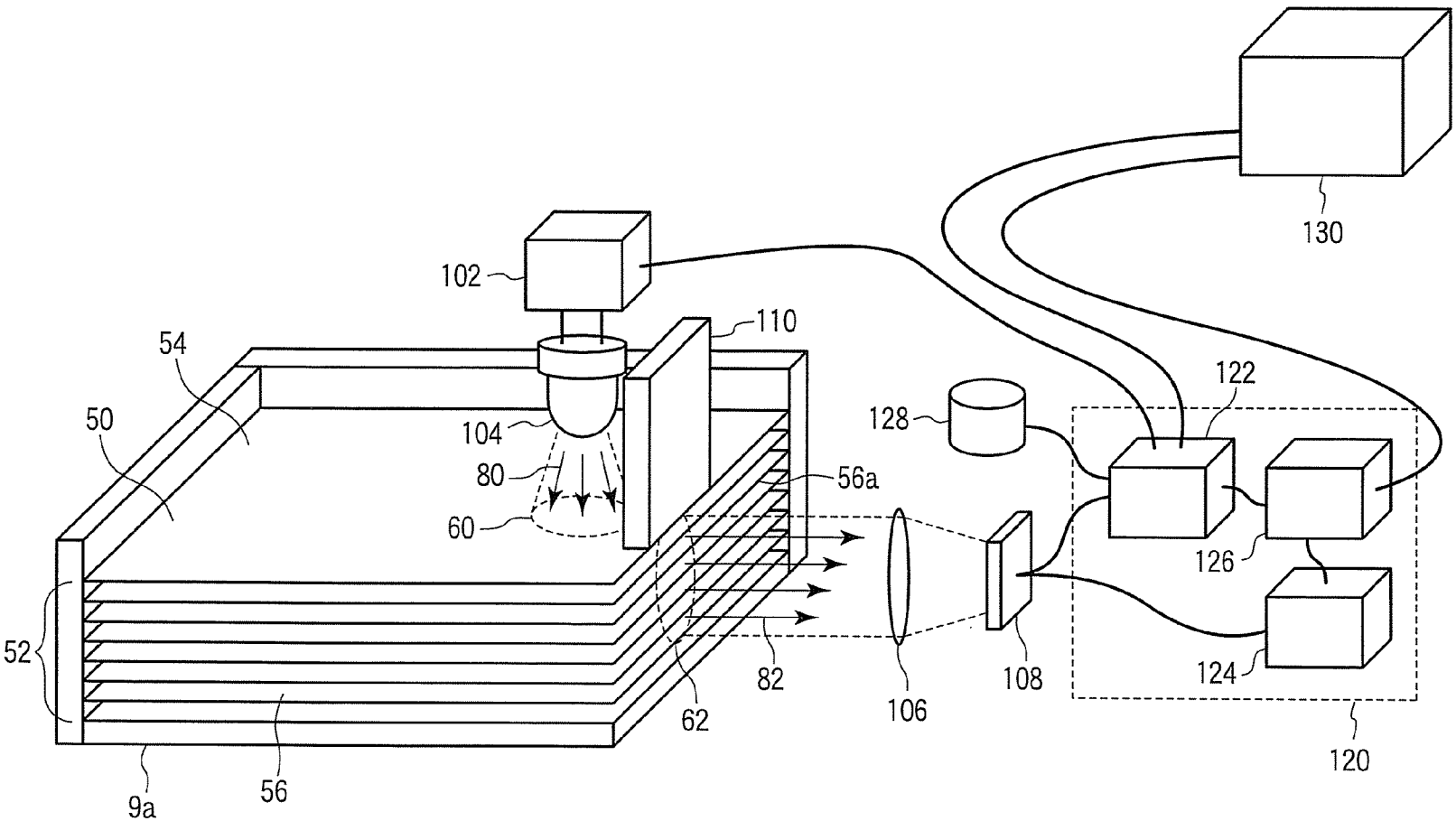
FIG. 2 is a schematic diagram showing a sheet type determination apparatus according to a first embodiment.

FIG. 2 is a schematic diagram showing a sheet type determination apparatus according to a first embodiment. This sheet type determination apparatus includes a device that determines the types of sheets 50 stacked in the sheet feed trays 9*a* and 9*b* and in the manual feeding tray 11, respectively. The embodiment will be described, based on the assumption that the sheet type determination apparatus determines the type of the sheets stacked in sheet feed tray 9*a*. Nonetheless, the sheet type determination apparatus can, of course, be used to determine the type of sheets stacked anywhere else.

As shown in FIG. 2, the sheets 50 placed in sheet feed tray 9*a* form a sheet bundle (also called a "pile of sheets") 52, which is almost a rectangular solid, including an upper surface 54, a lower surface, and two pairs of side surfaces 56. Each pair of the side surfaces 56 is opposed to each other and the side surfaces 56 extend in the direction the sheets 50 are stacked. Above the sheet bundle 52, a light source 104 is provided, which is, for example, an LED that emits illumination light, e.g., near-infrared light beam having a luminescence-center wavelength of 870 nm. The light source 104 emits illumination light 80 to the first region 60 on the upper surface 54 of the sheet bundle 52. The light source 104 is electrically connected to a light intensity adjustment unit 102. The light intensity adjustment unit 102 controls the light intensity of illumination light that the light source 104 emits.

The upper surface 54 denotes the surface of the uppermost sheet 50 of the sheet bundle 52 placed in sheet feed tray 9*a*. The lower surface denotes the surface of the lowermost sheet 50 of the sheet bundle 52, which has contact with the sheet feed tray 9*a*. The side surfaces 56 are defined by all ends of every sheet 50, i.e., the side surfaces 56 denote the surfaces of the sheet bundle 52 except for the upper surface 54 and the lower surface. Stacking direction denotes the direction in which the sheets 50 are stacked or laid one on another. Horizontal direction denotes the direction perpendicular to the stacking direction, and, in the embodiments, corresponds to the direction substantially parallel to the surface of each sheet 50.

The sheets may be stacked, one on another in contact, in the lateral direction or in the stacking direction. In this case, the upper surface 54 and lower surface of the sheet bundle are opposed to each other in the stacking direction, a pair of side surfaces are opposed to each other in a first orthogonal direction perpendicular to the stacking direction, and the other pair of side surfaces are opposed to each other in a second orthogonal direction perpendicular to the stacking direction and the first orthogonal direction. In this specification, the upper surface and lower surface of the sheet bundle are defined with respect to the stacking direction. Hence, the upper surface of the sheet bundle means the surface outermost in the stacking direction, and the lower surface of the sheet bundle means the surface that is innermost in the stacking direction. Thus, the sheet type determination apparatus, which will be described below, can work well even if the sheets are stacked, one on another in contact, in the stacking direction.

In the sheet type determination apparatus shown in FIG. 2, the illumination light 80 applied to the first region 60 is partially diffused and reflected at the upper surface 54 of the sheet bundle 52, and a part of the illumination light 80 enters the sheet bundle 52. The illumination light 80 entering the sheet bundle 52 passes through the sheet bundle 52 and emerges from the side surfaces 56 of the sheet bundle 52. Transmitted light 82 emerging from the second region 62 on the side surface 56*a* of the sheet bundle 52 is focused by a focusing lens 106 that is arranged opposite the second region 62. Transmitted light 82 so focused by the focusing lens 106 is measured, in terms of light intensity, by a light-receiving element 108 arranged in the focal plane of the focusing lens 106. For example, the light-receiving element 108 is an area sensor including CMOS image sensors arranged in a two-dimensional array. The light-receiving element 108 images the second region 62 to measure the two-dimensional light intensity distribution in the second region 62. The focusing lens 106 and the light-receiving element 108 forms a detection unit that detects the light intensity distribution of the transmitted light 82 in the second region 62. The second region 62 on side surface 56*a* of the sheet bundle 52 does not overlap the first region 60 on the upper surface 54 of the sheet bundle 52, and corresponds to a bright region illuminated with the light beams leaking through the gaps between the sheets 50 of the sheet bundle 52 as the light passes through the sheet bundle 52.

The sheet type determination apparatus further includes a light blocking member 110, which is, for example, a rectangular plate made of resin. The light blocking member 110 is arranged, contacting the upper surface 54 of the sheet bundle 52, at a position inner by a short distance, e.g., 1 mm from the edge defined by the upper surface 54 and the side surface 56*a*. The light blocking member 110 is so positioned that the illumination light 80 applied by the light source 104 and the reflected light from the upper surface 54 of the sheet 50 may not be directly applied to the light-receiving element 108.

The light-receiving element 108 detects the transmitted light 82 emerging from the second region 62, and then outputs, to an operation unit 120, the data on the light intensity distribution in the second region 62. In the operation unit 120, a sheet type determination unit 122 determines the type and density of the sheet 50 based on the light intensity distribution data. Also in the operation unit 120, a sheet thickness calculation unit 124 calculates the thickness of the sheet 50. Further, a grammage calculation unit 126 calculates the grammage of the sheet 50 from the density and thickness of the sheet 50 which are determined by the sheet type determination unit 122 and sheet thickness calculation unit 124, respectively. The grammage means the weight of the sheet 50 per square meter. Thus, the grammage is calculated by multiplying the density of the sheet 50 by the thickness of the sheet 50.

The type, thickness and grammage of the sheet 50, either determined calculated in the operation unit 120, are output to a main processing unit 130. The main processing unit 130 sets the conditions of forming images in accordance with the type, thickness and grammage of the sheet 50. The sheet type determination unit 122 also determines, based on the image data generated by the light-receiving element 108, whether the intensity of light emitted by the light source 104 is appropriate or not. The sheet type determination unit 122 then instructs the light intensity adjustment unit 102 to adjust the intensity of light.

Figure 3:
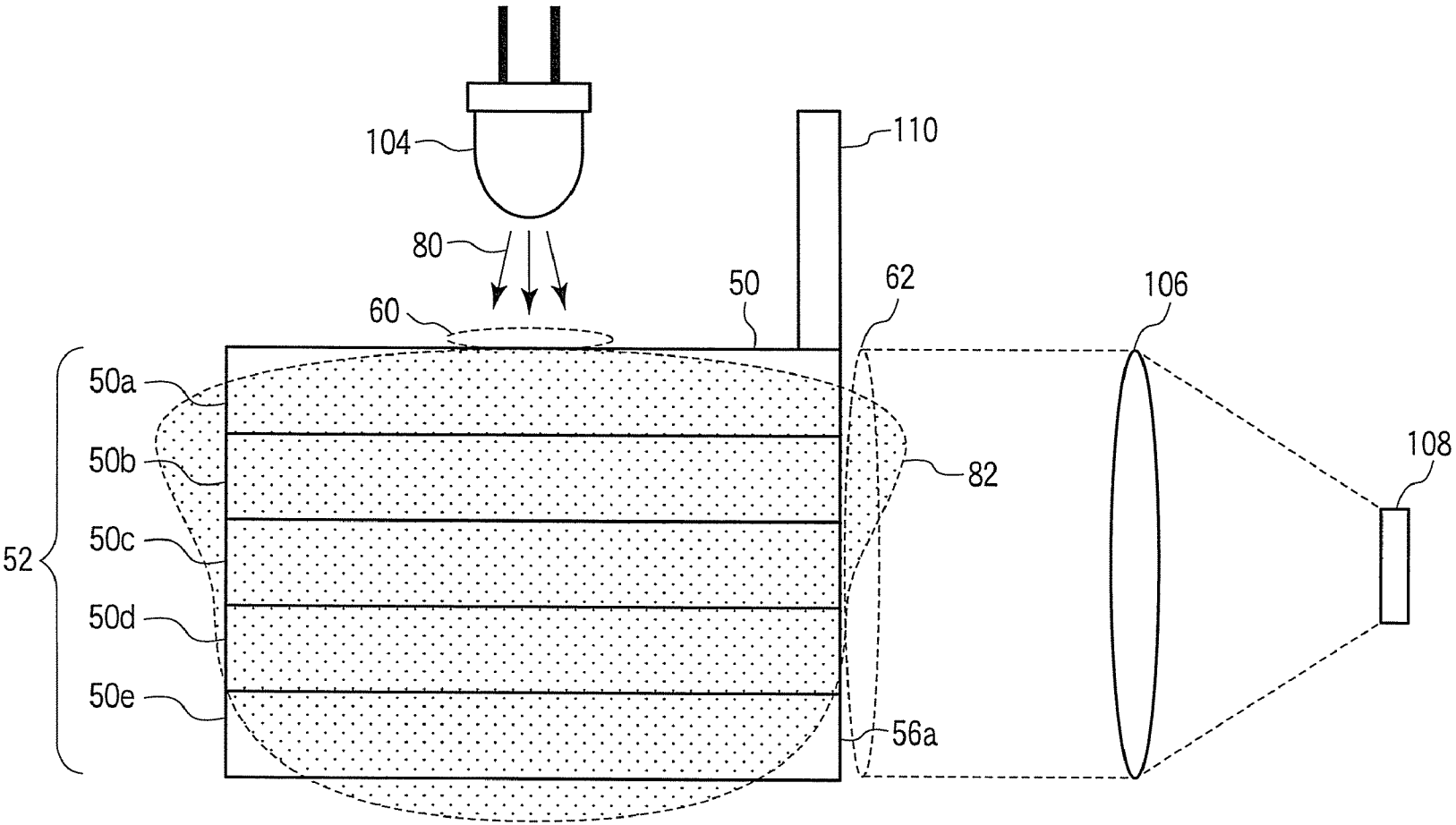
FIG. 3 is a schematic diagram explaining how light passes through the sheet bundle shown in FIG. 2.

FIG. 3 schematically shows how the illumination light 80 passes through the sheet bundle 52. As shown in FIG. 3, the illumination light 80 applied to the first region 60 on the sheet bundle 52 is partially diffused and reflected at the surface of the uppermost sheet 50*a* of the sheet bundle 52. A part of the illumination light 80 enters the sheet 50*a*. The illumination light 80 entering the sheet 50*a* passes through the sheet 50*a*, reaching the surface of the sheet 50*b* laid under the sheet 50*a*. The light reaching the surface of the sheet 50*b* is partially diffused and reflected at the surface of the sheet 50*b*. A part of this light enters the sheet 50*b* and passes through this sheet 50*b*, reaching the surface of the sheet 50*c* being laid under the sheet 50*b*. The light reflected at the surface of the sheet 50*b* is also diffused and reflected at the lower surface of the sheet 50*a*. A part of this light enters the sheet 50*a*. Light is similarly reflected by, and passes through, the sheets 50*d* and 50*e* laid below the sheet 50*c*.

Thus, the illumination light 80 is repeatedly reflected in the sheet bundle 52, each time at one sheet 50, and is thereby diffused toward the side surfaces 56 of the sheet bundle 52. The illumination light 80, so reflected repeatedly, reaches the side surfaces 56 and emerges, as transmitted light 82, from the side surfaces 56 of the sheet bundle 52. The transmitted light 82 emerging from the second region 62 on the side surface 56*a* of the sheet bundle 52 reaches the light-receiving element 108. The light-receiving element 108 images the second region 62, whereby the light intensity distribution of the transmitted light is measured.

As described above, the illumination light 80 is reflected, in part, at the upper surface 54 of the sheet 50. Nonetheless, the light so reflected scarcely reaches the light-receiving element 108. This is because the first region 60 and the second region 62 are located at different surfaces of the sheet bundle 52, and also because the light blocking member 110 is provided. If light other than the transmitted light 82, such as the illumination light 80 emitted from the light source 104 and the reflected light from the first region 60, is applied to the light-receiving element 108, then the acquired image will have flare, etc., inevitably degrading the image data that the light-receiving element 108 generates. If the second region 62 is illuminated with the illumination light 80 emitted from the light source 104, the second region 62 becomes so bright that the contrast of light intensity distribution decreases in the second region 62. In order to avoid this undesired event, the second region 62 is set, not overlapping the first region 60 at all, and the light blocking member 110 is arranged between the light source 104 and the light-receiving element 108.

The meaning that the first region 60 illuminated with the illumination light 80 emitted from the light source 104 does not overlap the second region 62 at which the light-receiving element 108 measures the transmitted light 82 will be explained below. The non-overlapping of the first region 60 and second region 62 means that the light-receiving element 108 measures only the transmitted light 82 emerging from the second region 62, not measuring the light directly reflected at the first region 60. In this embodiment, the first region 60 and second region 62 are set at different surfaces of the sheet bundle 52, thereby preventing the first region 60 and second region 62 from overlapping each other. That is, the light source 104 and the light-receiving element 108 are so arranged that the first region 60 and second region 62 may lie at different surfaces of the sheet bundle 52. In addition, the light blocking member 110 is arranged between the light source 104 and the light-receiving element 108 so as to prevent light other than the transmitted light 82 from entering the light-receiving element 108 as much as possible. The light blocking member 110 need not be provided if the light source 104 and the light-receiving element 108 are arranged so as to prevent light other than the transmitted light 82 from entering the light-receiving element 108 as much as possible.

It suffices if a principal part of the second region 62 does not overlap the first region 60. Even if the second region 62 overlaps the first region 60 a little, the first region 60 and the second region 62 can be regarded as different regions.

Further, the first region 60 and the second region 62 may be formed on the same surface unless the second region 62 does not overlap the first region 60. In this case, the light blocking member 110 is so arranged that neither the light coming directly from the light source 104 nor the light reflected at the surface of the sheet may be detected by the light source 104.

Figure 4:
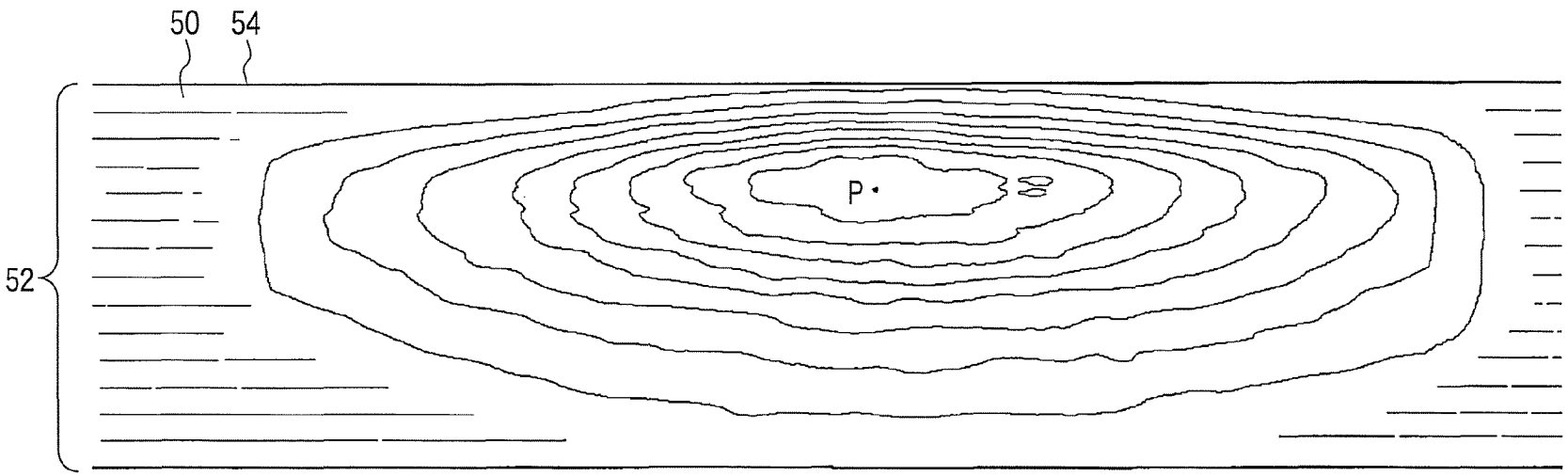
FIG. 4 is a diagram showing the light intensity distribution of the transmitted light, detected by the light-receiving element shown in FIG. 2.

FIG. 4 schematically shows the image data of the transmitted light 82 which generated by the light receiving element 108. In FIG. 4, the changes in the light intensity are represented by contour lines. As shown in FIG. 4, the intensity of transmitted light 82 reaches the maximum at point P, and gradually decreases away from Point P. This is because the farther from the light source 104, the more greatly the illumination light 80 is attenuated, since the illumination light 80 is repeatedly reflected and absorbed. Since this attenuation of the illumination light 80 differs from one type to another of sheets 50, the sheet type determination apparatus of FIG. 2 can therefore determine the type of the sheets 50 by analyzing the light intensity distribution of the transmitted light 82. Although not clearly shown in FIG. 4, the intensity of transmitted light 82 is high in the gaps between the sheets 50. At the edges of each sheet 50, the light intensity of transmitted light 82 is low, because most of the light 80 has been absorbed until the light 80 reaches the side surface 56*a*. Thus, the light intensity distribution has peaks that accord with the thickness of the sheet 50. Hence, the thickness of the sheet 50 can be calculated by analyzing the light intensity distribution. Moreover, the attenuation rate of the light can be more accurately obtained by measuring the transmitted light 82 passing through a plurality of sheets 50, than in the conventional method in which light is applied to one sheet and the attenuation rate of the light that has passed through the sheet is measured.

Figure 5:
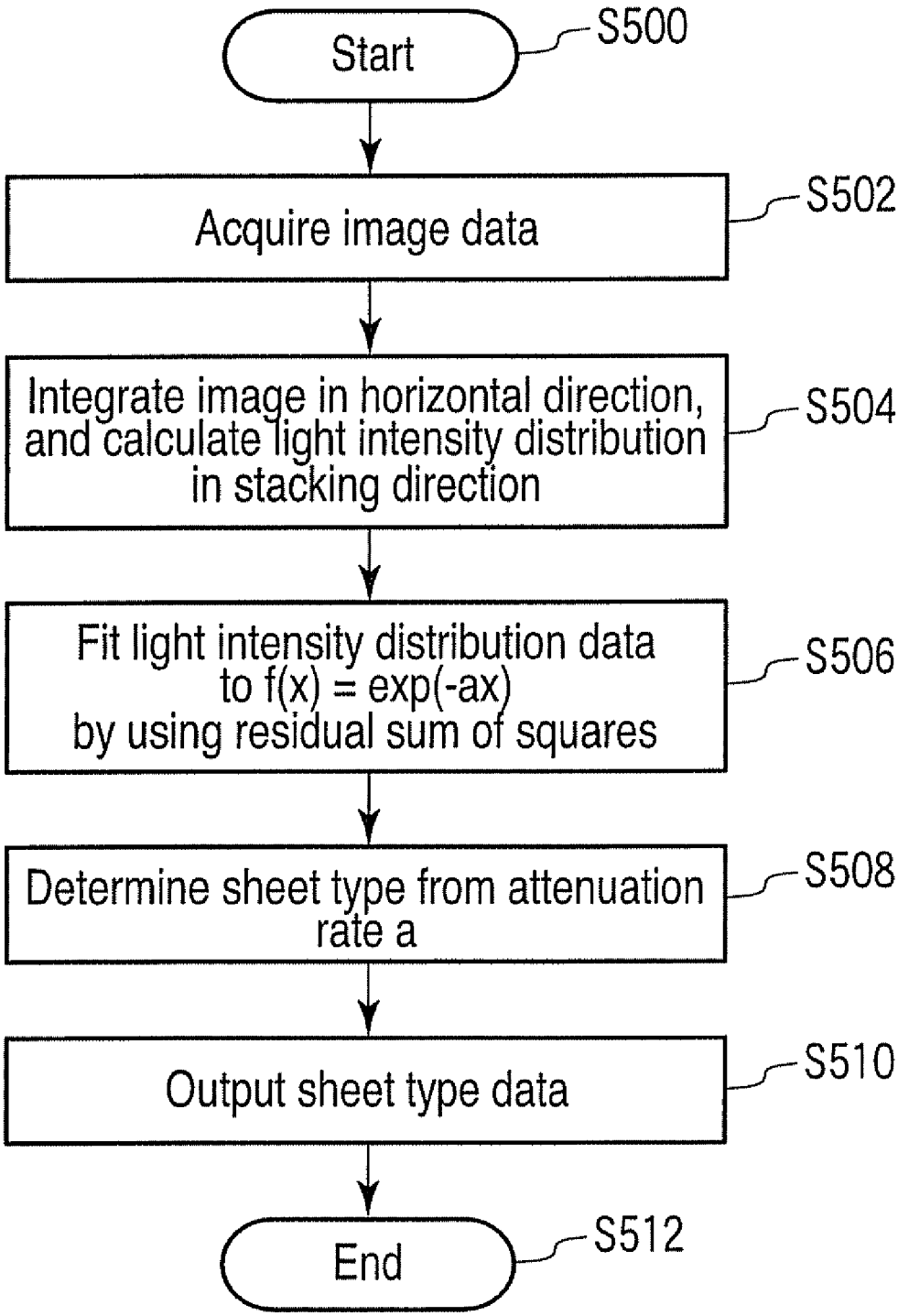
FIG. 5 is a flowchart showing the sequence of a process by which the sheet type determination unit shown in FIG. 2 determines the type of a sheet.

FIG. 5 shows the sequence of a process by which the sheet determination unit shown in FIG. 2 determines the type of the sheet 50 based on the light intensity distribution of the transmitted light 82 that emerges from the second region 62.

As shown in FIG. 5, a process of determining the type of sheet 50 is started in Step S500. The illumination light 80, which has been applied to the first region 60 by the light source 104, passes through the sheet bundle 52 and emerges from the second region 62 on the side surface 56*a* of the sheet bundle 52. The light-receiving element 108 images the light intensity distribution of the transmitted light 82 emerging from the second region 62 to generate such image data as shown in FIG. 4 (Step S502). The image data generated in Step S502 represents a light intensity distribution in which the light intensity is gradually attenuated away from a point P in the image. The attenuation rate of the light intensity is correlated to the type of the sheet 50. The sheet type determination unit 122 divides the image data into lines, each having a one-pixel width and extending in the stacking direction. The light intensity distributions based on the pixel values pertaining to the respective lines are integrated in the horizontal direction, over a given pixel width of the image data, thereby generating data representing one-dimensional light intensity distribution in the second region 62 with respect to the stacking direction (Step S504). The light intensity distribution data, thus generated, is compared with an attenuation curve, expressed by, for example, $f(x)=\exp(-ax)$, thereby calculating a value for "a", which minimizes the residual sum of squares for the distribution and the attenuation curve (Step S506). This value "a" indicates an attenuation rate. A lookup table, stored in a database 128 and describing the relation between various attenuation rates and various sheet types (types of sheets), is referred with the attenuation rate a calculated, thereby determining the type of the sheets 50 (Step S508). The sheet type determination unit 122 outputs the data representing the determined type of the sheet to the main processing unit 130 (Step S510). The process of determining the type of the sheet 50 is then terminated (Step S512).

Figures 6, 7:
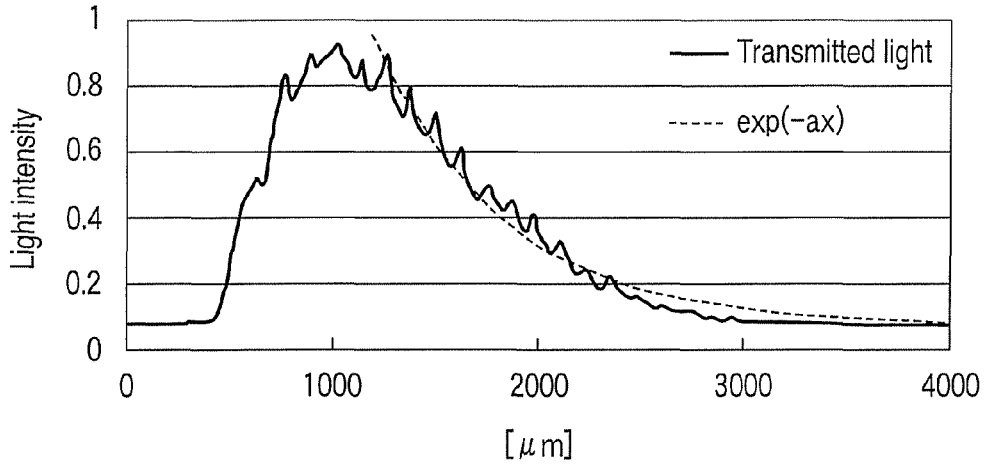
FIG. 6 is a graph showing the one-dimensional light intensity distribution of the transmitted light, obtained from the light intensity distribution shown in FIG. 4.
FIG. 7 is a table stored in the database shown in FIG. 2 and describing the relation between attenuation rates and types of sheets.

FIG. 6 shows the light intensity distribution of the transmitted light 82, calculated in Step S504 shown in FIG. 5. In FIG. 6, the transverse axis is set to the distance along the line extending in the stacking direction, and the vertical axis is set to the light intensity of the transmitted light 82 which has been normalized. The region to be integrated in Step S504 is set for 100 pixels on the right and 100 pixels on the left, arranged in the horizontal direction, with respect to the center of the image. As shown in FIG. 6, the data pertaining to a region up to a distance extending, for example, 200 μm from the point having the maximal value, is not used as the data for fitting the curve. That is, in the instance of FIG. 6, the curve, $f(x)=\exp(-ax)$ is fitted to the light intensity in any region at distance of 1200 μm or more since the light intensity reaches the maximum value at the distance of 1000 μm. In the instance of FIG. 6, the attenuation rate a calculated is 0.0087. The sheet type determination unit 122 refers to the first lookup table, describing the relation between the attenuation rates and the sheet types and stored in the database 128, with the calculated attenuation rate a, thereby determining the type of the sheets 50 placed in sheet feed tray 9*a*.

The attenuation curve f(x) is not limited to f(x)=exp(−ax). Rather, it may be any other function so long as the attenuation rate a can be used as parameter and be fitted to the light intensity distribution of the transmitted light 82.

Step S504 in FIG. 5 may be omitted, in which the light intensity distribution of the image data is integrated in the horizontal direction to generate the data representing one-dimensional light intensity distribution, shown in FIG. 6. If this is the case, one line will be extracted from the image data, which has a one-pixel width and extends in the stacking direction, and the attenuation rate a will be calculated from the light intensity distribution along the line so extracted. The experiments the inventors hereof have conducted show that in the case where the light-receiving element 108 generates two-dimensional image data, the attenuation of the light passing through the sheet bundle 52 becomes clearer if Step S504 is performed, integrating the light intensity in the horizontal direction and thereby calculating the light intensity distribution in the stacking direction.

In this embodiment, the light-receiving element 108 acquires an image of the two-dimensional light intensity distribution in the second region, and the sheet type determination unit 122 calculates the attenuation rate based on the image data. To calculate the attenuation rate, it suffices to acquire the light intensity in at least the stacking direction. Therefore, the light-receiving element 108 may include CMOS image sensors arranged in the form of a one-dimensional array extending in the stacking direction, and may image a one-dimensional light intensity distribution in the stacking direction. In this case, the sheet type determination unit 122 can skip Step S504 of integrating, in the horizontal direction, the light intensity distribution represented by the image data. Further, the direction to calculate the attenuation rate is not limited to the stacking direction of the sheets 50. Instead, the attenuation rate may be calculated from the light intensity distribution in the horizontal direction or in an oblique direction.

FIG. 7 shows an exemplary first lookup table stored in the database 128 and describing the relation between attenuation rates and sheet types. The first lookup table describes various attenuation rates of the transmitted light 82 and the sheet types and densities of sheets 50, which are associated with the various attenuation rates, respectively. The sheet type determination unit 122 first retrieves the attenuation rate column of the first lookup table, determining in which range the attenuation rate a calculated falls. If the attenuation rate a falls within the range of A11 to A12, the sheet type determination unit 122 determines that each sheet 50 placed in sheet feed tray 9*a* is standard paper 1, and acquiring the density associated with the attenuation rate a. The data representing the type and density of the sheet 50 is output to the main processing unit 130 and the grammage calculation unit 126.

Like the sheet type determination unit 122, the sheet thickness calculation unit 124 calculates the light intensity distribution of the transmitted light 82, with respect to the stacking direction of the sheet bundle 52, from the image data generated by the light-receiving element 108. The sheet thickness calculation unit 124 also calculates the intervals of the peaks observed in this light intensity distribution, calculating the thickness of one sheet 50 and generating thickness data representing the thickness of the sheet 50. The thickness data is output to the grammage calculation unit 126.

The grammage calculation unit 126 calculates the grammage of the sheet 50 by multiplying the density of the sheet 50, acquired at the sheet type determination unit 122, by the thickness of the sheet 50, calculated at the sheet thickness calculation unit 124. The grammage calculation unit 126 outputs the data representing the grammage of the sheet 50 to the main processing unit 130. When the data representing the type and grammage of the sheet 50 is input to the main processing unit 130, the main processing unit 130 sets various conditions for the image formation process.

Figures 8, 9:
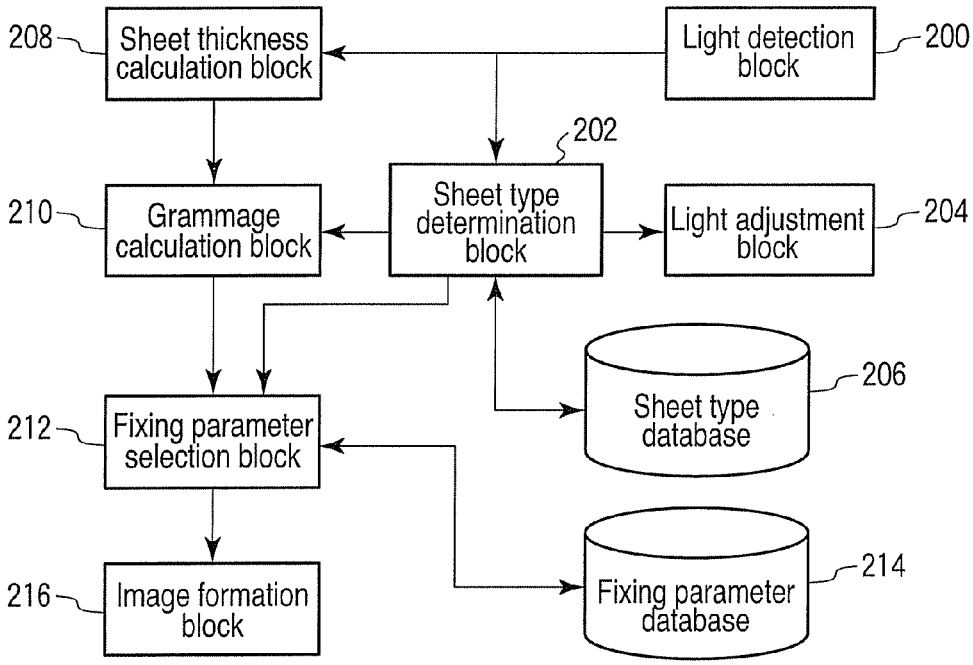
FIG. 8 is a block diagram showing an image formation apparatus including the sheet type determination apparatus shown in FIG. 2.
FIG. 9 is a table stored in the fixing parameter database shown in FIG. 8 and describing the relation between the types of sheets and the fixing parameters.

FIG. 8 is a block diagram schematically showing the function blocks of an image formation apparatus that includes such a sheet type determination apparatus as shown in FIG. 2. The light detection block 200 shown in FIG. 8 includes the focusing lens 106 and the light-receiving element 108, both shown in FIG. 2. The light detection block 200 detects the transmitted light 82 emerging from the second region 62 of the sheet bundle 52 to generate image data. The image data generated by the light detection block 200 is output to a sheet type determination block 202 and a sheet thickness calculation block 208. The sheet type determination block 202 first derives the light intensity distribution of the transmitted light 82 from the image data and then calculates the attenuation rate of the transmitted light 82 based on the light intensity distribution data.

Further, the sheet type determination block 202 determines whether the intensity of illumination light 80 emitted from the light source 104 is appropriate or not, based on the light intensity of transmitted light 82. If the sheet type determination block 202 fails to calculate the attenuation rate of the transmitted light, even by processing the image data input from the light detection block 200, it instructs a light adjustment block 204 to adjust the intensity of illumination light 80 that the light source 104 emits.

The light detection block 200 fails to generate image data with an appropriate light intensity. In this case, the light detection block 200 may be controlled to change the exposure condition of acquiring the image data, such as shutter speed or gain, so as to generate image data with an appropriate light intensity.

Moreover, the light intensity of illumination light 80 emitted by the light source 104 may be gradually changed, and the transmitted light 82 passing through the sheet bundle 52 may be imaged each time the light intensity is changed. Of the image data items thus generated, the data representing the most appropriate light intensity distribution may be used to determine the type of the sheet 50.

A sheet type database 206 stores such a first lookup table as shown in FIG. 7, which describes the relation between the attenuation rates of transmitted light and the types of the sheets 50. The sheet type determination block 202 determines the type of the sheet 50 by referring to the first lookup table stored in the sheet type database 206 with the attenuation rate calculated for the transmitted light. The first lookup table also describes the densities of the sheets 50, which are associated with the attenuation rates of the transmitted light. The sheet type determination block 202 therefore acquires the type of the sheet 50 as well as the density of the sheet 50. The sheet type determination block 202 outputs the density data about sheet 50 to a grammage calculation block 210, and the sheet-type data and density data about the sheet 50 to a fixing parameter selection block 212.

The sheet thickness calculation block 208 calculates the thickness of the sheet 50 based on the image data received from the light detection block 200. The data representing the thickness of the sheet 50 is output to the grammage calculation block 210. To the grammage calculation block 210, the data representing the thickness of the sheet 50 is input from the sheet thickness calculation block 208, and the data representing the density of the sheet 50 is input from the sheet type determination block 202. The grammage calculation block 210 calculates the grammage by multiplying the thickness of the sheet 50 by the density thereof. The data representing the grammage of the sheet 50 is output to the fixing parameter selection block 212.

The fixing parameter selection block 212 uses the data representing the type of the sheet 50, input from the sheet type determination block 202, referring to a fixing parameter database 214 thereby determining parameter values important in printing, such as the temperature of the fixing unit (e.g., fixing roller pair 6) that fixes ink in the process of forming an image on the sheet 50. The fixing parameter database 214 stores various parameter values that are optimal for the thickness of the sheet 50, in association with the type and grammage of the sheet 50. These parameter values include the contact force of the rollers for conveying the sheet 50 to the print unit, and the transfer bias used for forming or printing an image.

FIG. 9 shows an exemplary second lookup table stored in the fixing parameter database 214. The second lookup table describes target fixing temperatures for the fixing unit and sheet conveyance speeds at which to convey sheets from the image transfer unit to the fixing unit, in association with the types of sheets 50. The fixing parameter selection block 212 selects a target fixing temperature and a sheet conveyance speed in accordance with the data items representing the type and grammage of the sheet 50. In one example, the sheet type determination block 202 determines that the type of the sheet 50 is heavy paper 2, and the grammage calculation block 210 calculates a grammage C for the sheet 50, which ranges from C41 to C42. In this case, the fixing parameter selection block 212 selects sheet conveyance speed E2 and target fixing temperature D ranging from temperature D14 to temperature D42, which is appropriate for the grammage C. The fixing parameter selection block 212 outputs the data items representing the sheet conveyance speed and the target fixing temperature, both selected, to an image formation block 216.

The image formation block 216 forms an image on the sheet 50 in accordance with the data items representing the sheet conveyance speed, target fixing temperature, etc. The above-described process of determining the type of the sheet 50 is performed, for example when sheet feed tray 9*a* is opened and closed, or when the image formation apparatus is powered on. The image formation block 216 can form images in the best possible conditions as various conditions of image formation are stored in a memory (not shown).

The second lookup table shown in FIG. 9 may be so described that the contact force of the rollers for conveying the sheet 50 to the print unit, and the transfer bias for transferring the toner image from the transfer belt 33 to the sheet 50, and the like are associated with the type or thickness of the sheet 50. In this case, the data representing the contact force of the sheet conveyance rollers, which is associated with the data representing the thickness calculated by the sheet thickness calculation block 208, is output to the image formation block 216. The sheet 50 can therefore be conveyed in a stable state. In addition, incorrect transfer of a toner image and toner retransfer, i.e., toner transfer back to the photosensitive drum, can be prevented, because the optimal transfer bias has been output to the image formation block 216 and the block 216 operates at the optimal transfer bias.

Thus, the image formation apparatus shown in FIG. 1 can measure the light intensity distribution of the transmitted light 82 that has passed through the sheet bundle 52, calculate, based on the light intensity distribution, the attenuation rate of the transmitted light to determine the type of the sheet 50, and set the optimal printing parameters before performing the printing job.

Figure 10:
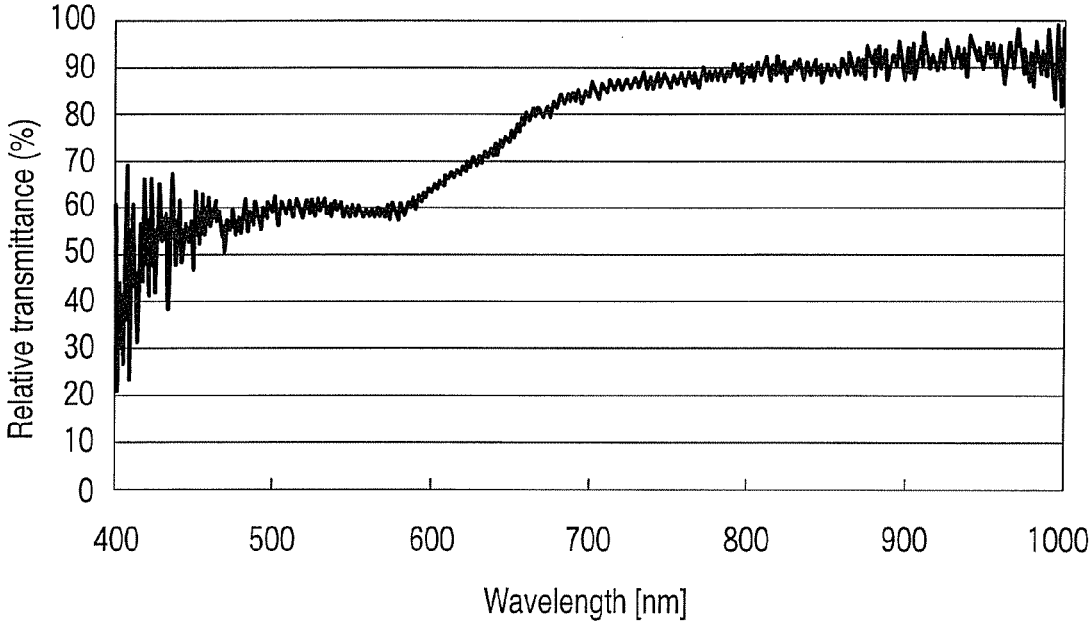
FIG. 10 is a graph showing the relative transmittance of the sheet with respect to the wavelength of the light emitted from the light source shown in FIG. 2.

As described above, the illumination light 80 applied to the sheet bundle 52 is, for example, near-infrared light. Nonetheless, it may be other light such as red light. FIG. 10 shows the relative transmittance of the sheet 50 with respect to the illumination light 80 having a wavelength ranging from 400 to 1000 nm. The relative transmittance shown in FIG. 10 is a ratio of the light intensity to a reference value that is the maximum intensity of light having a wavelength ranging from 400 to 1000 nm. As seen from FIG. 10, the relative transmittance of the sheet 50 is high to near-infrared light having a wavelength of 700 nm or more. Near-infrared light having a wavelength of 700 nm or more therefore is barely attenuated in the sheet bundle 52, and penetrates deep into the sheet bundle 52. Hence, the light intensity distribution of the transmitted light 82 can be measured over a greater part of the side surface 56 of sheets 50.

The light-receiving element 108, which is configured to measure the light intensity distribution of the transmitted light 82 emerging from the second region 62 on the sheet bundle 52, is not limited to an area sensor including imaging elements arranged in a two-dimensional array. It may instead be a photodetector array or a line sensor which is a one-dimensional imaging elements array. Alternatively, the light-receiving element 108 may be formed by photodiodes arranged at one or more positions, and may be designed to measure the intensity of the transmitted light 82 at a prescribed distance from the light source 104. In this case, the light intensity may be measured at the side surface 56 in the stacking direction, horizontal direction or oblique direction. Further, it is not limited to the area sensor including CMOS image sensors, and an area sensor including CCD image sensors may be utilized.

As the focusing lens 106, it is possible to use a gradient index lens or a cylindrical lens. If a gradient index lens is used in combination with the light-receiving element 108 that is either a line sensor or an area sensor, the imaging distance from the side surface 56 can be shortened, ultimately making the apparatus compact. If a cylindrical lens is used in combination with a line sensor, it will focus those beams of light, which extend in the horizontal direction of the sheet bundle 52, on the line sensor. In this case, more transmitted light 82 can be acquired in the horizontal direction, achieving the same advantage as in this embodiment that uses an area sensor as light-receiving element 108. That is, a one-dimensional light intensity distribution can be acquired without performing a process (Step S504) of integrating, in the horizontal direction, the light intensity values represented by the image data.

Further, the imaging system can be rendered more compact if the light-receiving element 108 is set in direct contact with the side surface 52 of the sheet bundle 52 to image the second area 62.

The light-receiving element 108 is not limited to the above-described configurations. It may be of any other configuration, so far as it can generate image data based on the transmitted light 82 emerging from the second region 62 on the side surface 56 of the sheet bundle 52.

The light blocking member 110 may be any type that prevents light other than the transmitted light 82 from reaching the light-receiving element 108. For example, an optical fiber propagates light that satisfies the total internal reflection condition, and generates only light beams at angles falling within a specific range, with respect to the axis of the fiber. Hence, no light will directly be applied from the optical fiber to the light-receiving element 108 if the light-receiving element 108 is arranged outside a region defined by such an angle. In this optical system, the optical fiber is equivalent to the light blocking member 110.

The light blocking member 110 is not limited to a rectangular plate. The light blocking member 110 may be formed of a cylindrical or rectangular tube so as to surround the light source 104. If the light source 104 is surrounded by a cylindrical or rectangular light blocking member 110, and the light blocking member 110 contacts the upper surface 54 of the sheet bundle 52, allowing light to enter the sheet bundle 52, light other than the transmitted light 82 will not applied to the light-receiving element 108. Therefore, the contrast of the signal in the light intensity distribution data can improve.

The light blocking member 110 may be made of any material that meets the object of not allowing light to pass, such as resin, metal or rubber. The light blocking member 110 may be an independent member or may be formed integral with the light source 104. Alternatively, the light blocking member 110 may be formed integral with the light-receiving element 108.

The light blocking member 110 is arranged so as to contact the sheet bundle 52. It may be configured to press the sheet bundle 52. The light blocking member 110 may contact the sheet bundle 52 in whichever manner possible, so long as it prevents light other than the transmitted light 82 from reaching the light-receiving element 108.

The light blocking member 110 is arranged at a position inner by a short distance of 1 mm from the edge of the sheet 50, in the first embodiment. Its position is not limited to this. For example, it may be arranged at the edge of the sheet 50. Anyway, the light blocking member 110 can be arranged at any position, so far as it can function as a light blocking member.

Moreover, the light blocking member 110 may include a drive unit, which can change the distance from the edge of the sheet. Therefore, the transmitted light 82 emerging from the second region 62 can be adjusted in intensity.

The method that the sheet thickness calculation unit 124 uses to calculate the thickness of the sheet 50 is not limited to the above-described one, in which the thickness is calculated directly from the intervals of the peaks observed in the light intensity distribution. The sheet thickness calculation unit 124 may instead perform a fast Fourier transform (FFT) on the waveform of the calculated light intensity distribution in the stacking direction, determining the position of a power spectrum peak and calculating the thickness of the sheet 50 from the position of this peak. In this case, the thickness of the sheet 50 can be calculated more accurately than by calculating it based on the intervals of the peaks observed in the light intensity distribution.

The sheet type determination apparatus according to this embodiment can be used in order to acquire the data about the sheet 50, not only in the multifunctional peripheral (MFP) and the laser printer, but also in printers such as bubble jet printer (trademark) and ink-jet printer and any other apparatus that that needs data about sheets.

(Second Embodiment)

A sheet type determination apparatus according to a second embodiment will be described with reference to FIG. 11 and FIG. 12.

Figure 11:
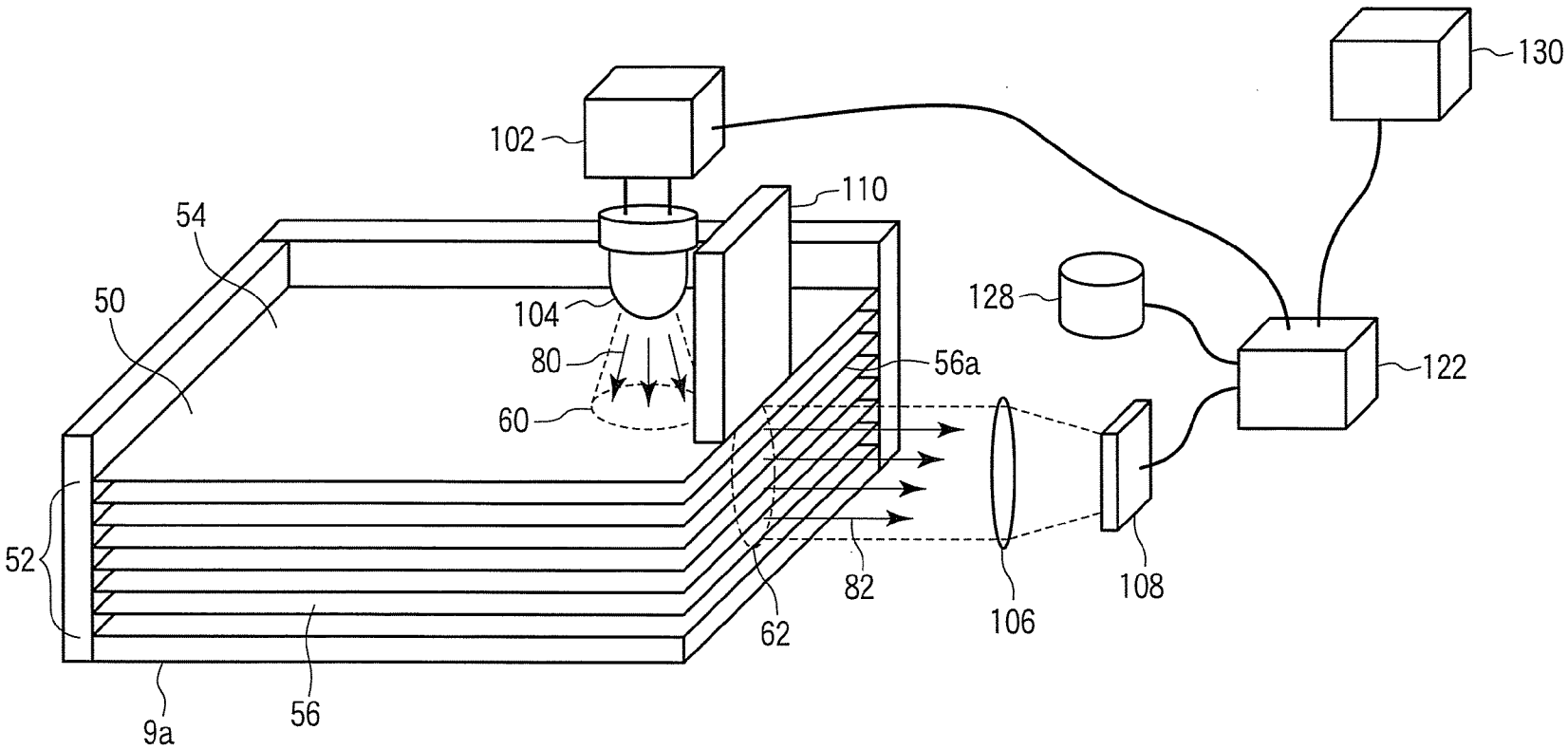
FIG. 11 is a schematic diagram showing a sheet type determination apparatus according to a second embodiment.

FIG. 11 schematically shows the arrangement of the sheet type determination apparatus according to the second embodiment. The process of calculating the thickness and grammage of the sheet 50 is not performed in the second embodiment, whereby the apparatus is simplified. As shown in FIG. 11, a sheet bundle 52 is placed in the sheet feed tray 9*a*. The light source 104 is arranged above the sheet bundle 52, and applies illumination light 80 to the first region 60 on the upper surface 54 of the sheet bundle 52. The illumination light 80 passes through the sheet bundle 52 and emerges from the side surfaces 56 of the sheet bundle 52. The second region 62 is imaged by a focusing lens 106 and light-receiving element 108, both arranged opposite the second region 62 of the side surface 56*a* of the sheet bundle 52, so that the transmitted light 82 that has passed through the sheet bundle 52 is detected.

The image signal representing the image acquired by the light-receiving element 108 is transmitted to the sheet type determination unit 122. The sheet type determination unit 122 performs the process of FIG. 5, determining the type of the sheet 50 based on the received image signal, and generating sheet type data. The sheet type data is output to the main processing unit 130. Further, the sheet type determination unit 122 instructs the light intensity adjustment unit 102 to adjust the intensity of light in accordance with the image signal.

Figure 12:
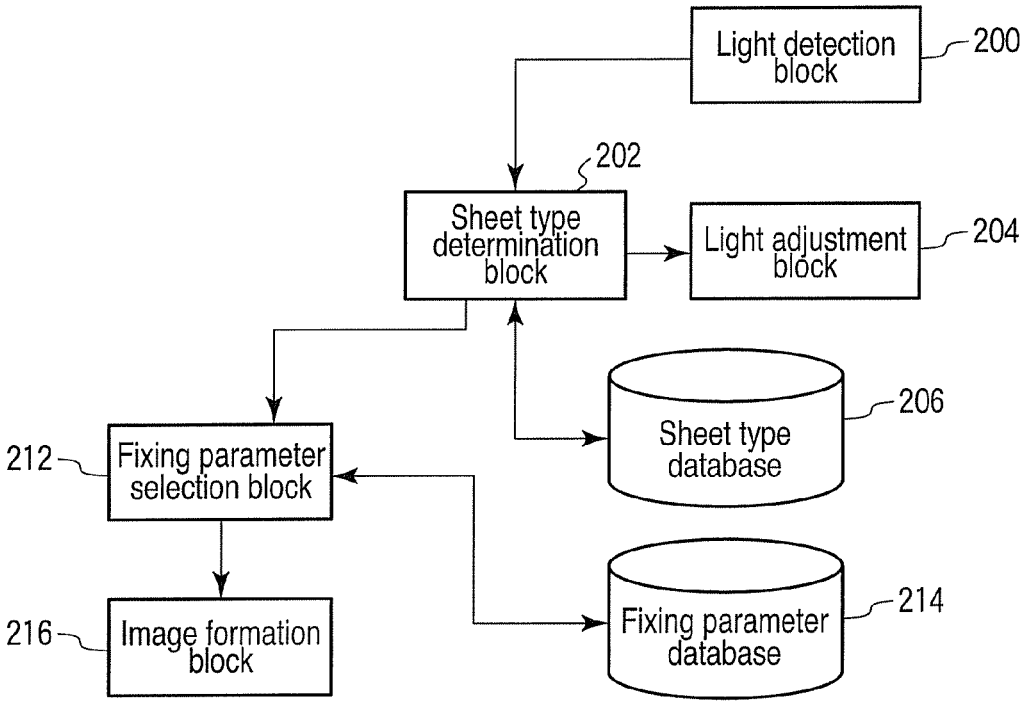
FIG. 12 is a block diagram showing an image formation apparatus including the sheet type determination apparatus shown in FIG. 11.

FIG. 12 schematically shows the function blocks of an image formation apparatus including the sheet type determination apparatus of FIG. 11. As shown in FIG. 12, the light detection block 200 images the second region 62 on the sheet bundle 52 to generate an image signal representing the image of the second region 62. The image signal is transmitted to the sheet type determination block 202. The sheet type determination block 202 calculates the attenuation rate a of the transmitted light 82 in accordance with the image signal, and refers to the first lookup table stored in the sheet type database 206, by using the calculated attenuation rate a, thereby determining the type of the sheet 50. The sheet type determination block 202 outputs the data presenting the type of the sheet 50 to the fixing parameter selection block 212.

The fixing parameter selection block 212 refers to the second lookup table stored in the fixing parameter database 214 by using the data representing the type of the sheet 50, thereby selecting a target fixing temperature and a target sheet conveyance speed. The image formation block 216 forms an image on the sheet 50 in accordance with the parameter values of the target fixing temperature and target sheet conveyance speed.

As described above, the operation unit 120 is simplified in configuration in the sheet type determination apparatus according to the second embodiment. The operation unit 120 determines the type of the sheet 50 based on the light intensity distribution of the transmitted light 82 that has passed through the sheet bundle 52. The image formation apparatus including this sheet type determination apparatus can set various conditions of an image formation process, and can therefore form images in accordance with these conditions.

(Third Embodiment)

Figure 13:
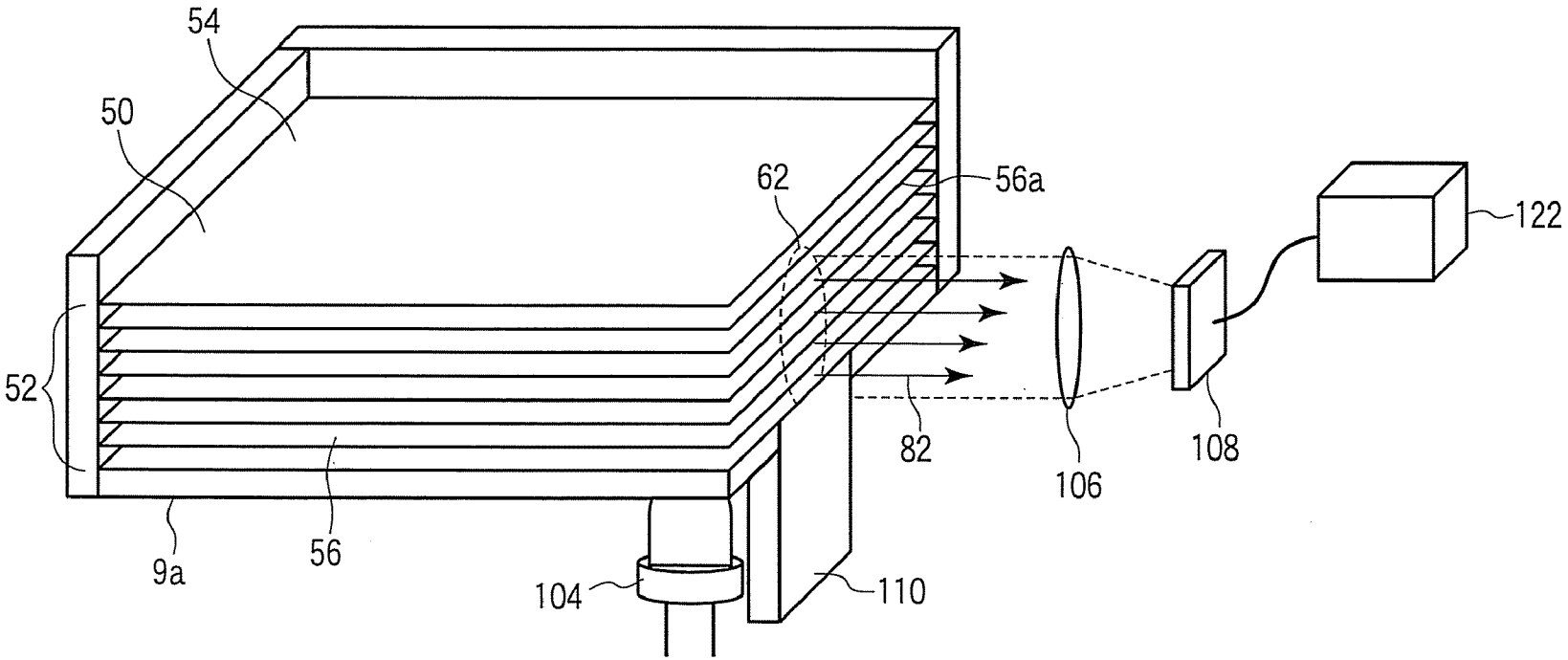
FIG. 13 is a schematic diagram showing a sheet type determination apparatus according to a third embodiment.

FIG. 13 schematically shows the arrangement of the sheet type determination apparatus according to the third embodiment. As shown in FIG. 13, a sheet bundle 52 is placed in the sheet feed tray 9*a*. The light source 104 is arranged below the sheet bundle 52, and applies illumination light 80 to the lower surface of the sheet bundle 52. The bottom of the sheet feed tray 9*a* has an opening (not shown), through which the illumination light 80 is applied to the first region 60 on the lower surface of the sheet bundle 52, entering the sheet bundle 52. The illumination light 80 passes through the sheet bundle 52 and emerges from the side surfaces 56 of the sheet bundle 52. The transmitted light 82, which has passed through the sheet bundle 52, is detected in such a manner that the focusing lens 106 and the light-receiving element 108, which are arranged opposite the second region 62 of the side surface 56*a* of the sheet bundle 52, image the second region 62. The lower surface of the sheet bundle 52 denotes a print side facing the bottom of the sheet feed tray 9*a*. The light blocking member 110 is arranged under the sheet feed tray 9*a*, because of the positions of the light source 104 and light-receiving element 108. The third embodiment can be compact in configuration, because the light source 104 and light blocking member 110 are arranged under the sheet feed tray 9*a*.

A plurality of light sources 104 may be provided to apply illumination light 80 to a plurality of surfaces of the sheet bundle 52. In this case, the light sources 104 are driven at the same time or alternately, whereby the light-receiving element 108 arranged opposite the side surface 56*a* of the sheet bundle 52 images the second region 62 to generate image data. The light intensity distribution of the transmitted light emerging from the second region 62 is calculated based on the image data, and then the attenuation rate of the transmitted light is calculated. As a result, the type of the sheets 50 is determined. In this arrangement, a first light source is arranged above the sheet bundle 52, and a second light source is arranged below the sheet bundle 52, for example.

Also in the case where the illumination light 80 is applied to a plurality of side surfaces of the sheet bundle 52, the light sources 104 and the light-receiving element 108 may be so arranged that the surface including the first region 60, which the light source 104 faces, may differ from the surface including the second region 62, which the light-receiving element 108 faces. In this case, too, the same advantages as described above can be achieved.

(Fourth Embodiment)

Figure 14:
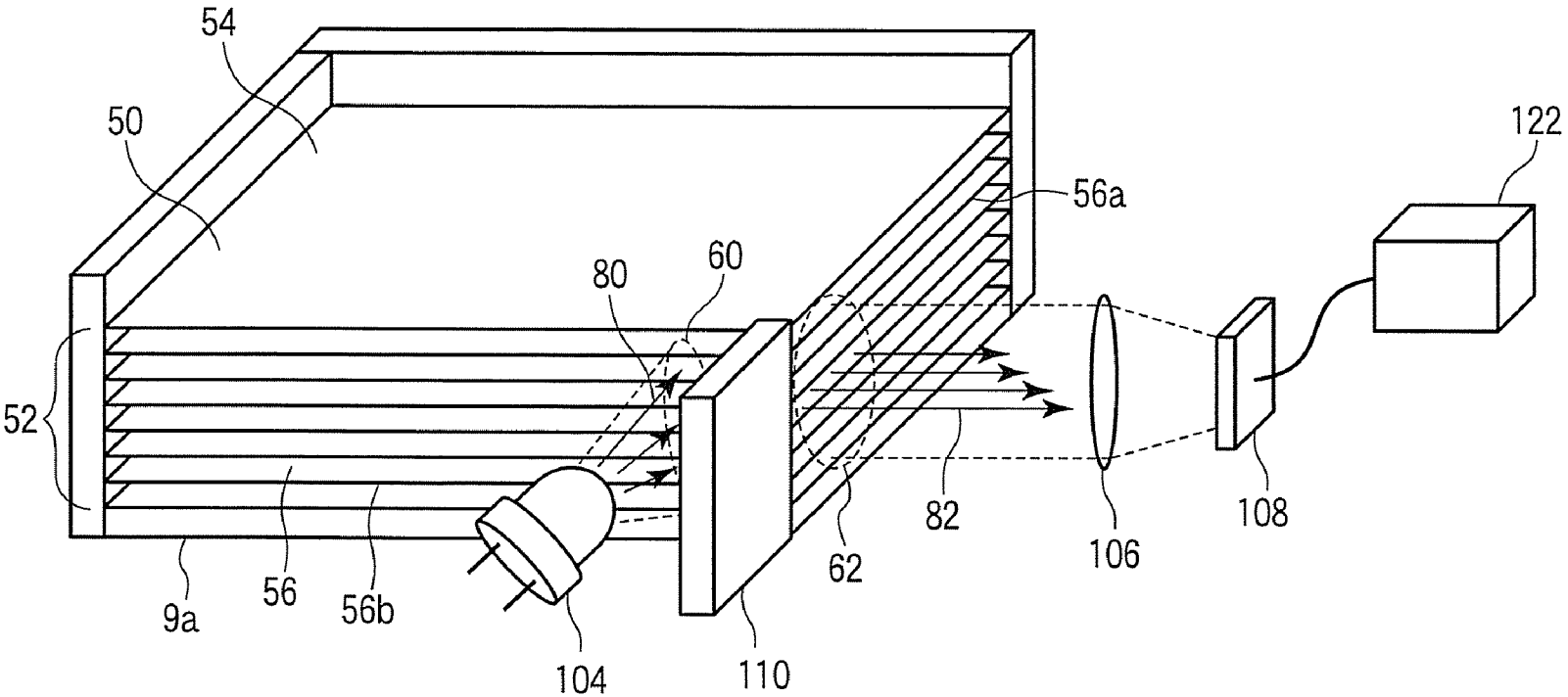
FIG. 14 is a schematic diagram showing a sheet type determination apparatus according to a fourth embodiment.

FIG. 14 schematically shows the arrangement of the sheet type determination apparatus according to a fourth embodiment.

As shown in FIG. 14, a sheet bundle 52 is placed in sheet feed tray 9*a*. The light source 104 is arranged opposite the side surface 56*b* of the sheet bundle 52, and applies illumination light 80 to the first region 60 on the side surface 56*b* of the sheet bundle 52. The illumination light 80 enters the sheet bundle 52 and passes through the sheet bundle 52. The transmitted light 82, i.e., light that has passed through the sheet bundle 52, emerges from the second region 62 on the side surface 56*a* of the sheet bundle 52, which differs from the side surface 56*b* thereof. The second region 62 is imaged by the focusing lens 106 and light-receiving element 108, both arranged opposite the second region 62, so that the transmitted light 82 is detected.

Since the light source 104 and light-receiving element 108 are arranged at a corner of the sheet bundle 52, the apparatus can be made compact.

(Fifth Embodiment)

Figure 15:
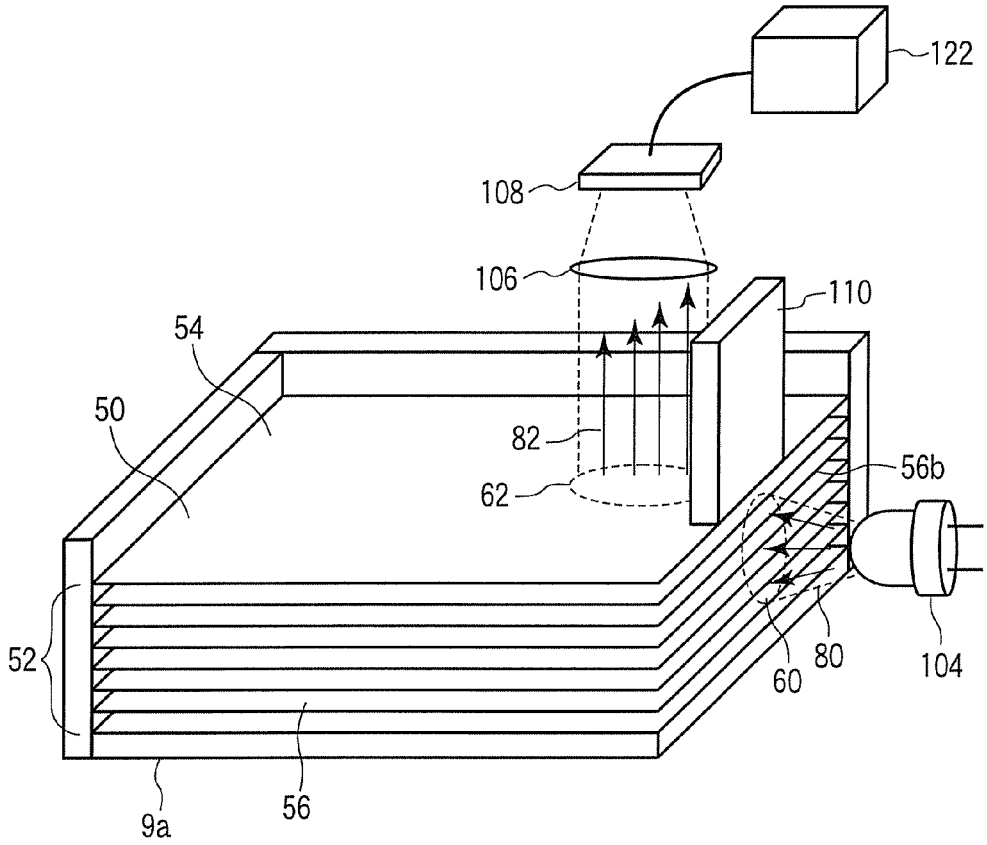
FIG. 15 is a schematic diagram showing a sheet type determination apparatus according to a fifth embodiment.

FIG. 15 schematically shows the configuration of the sheet type determination apparatus according to a fifth embodiment.

As shown in FIG. 15, a sheet bundle 52 is placed in sheet feed tray 9*a*. The light source 104 is arranged opposite the side surface 56*b* of the sheet bundle 52, and applies illumination light 80 to the first region 60 on the side surface 56*b* of the sheet bundle 52. From the first region 60, the illumination light 80 enters the sheet bundle 52 and then passes through the sheet bundle 52. The second region 62 is imaged by the focusing lens 106 and light-receiving element 108, both arranged opposite the second region 62, so that the transmitted light 82, passing through the sheet bundle 52 and emerging from the second region 62 in the upper surface 54 of the sheet bundle 52, is detected.

In the case where the light-receiving element 108 is arranged opposite the side surface 56 of the sheet bundle 52, the light-receiving element 108 measures such a light intensity distribution of the transmitted light 82 as shown in FIG. 6. As shown in FIG. 6, this light intensity distribution has peaks that accord with the thickness of the sheets 50. The unevenness in the light intensity in the stacking direction results from the difference in light intensity between the light 82 emitted from the edge of each sheet 50 and the light 82 emitted from the gap between any adjacent sheets 50. That is, this unevenness in light intensity is caused by measuring the transmitted light 82 emerging from the side surface 56 of the sheet bundle 52. In the fifth embodiment, since the light-receiving element 108 is arranged above the sheet bundle 52, a light intensity distribution free of such an unevenness can be obtained. As a result, the attenuation rate of the transmitted light can be calculated at high accuracy.

The focusing lens 106 and light-receiving element 108 need not be arranged above the sheet bundle 52. Rather, the focusing lens 106 and light-receiving element 108 may be arranged below the sheet bundle 52. In this case, too, the same advantages as described above can be achieved.

(Sixth Embodiment)

Figure 16:
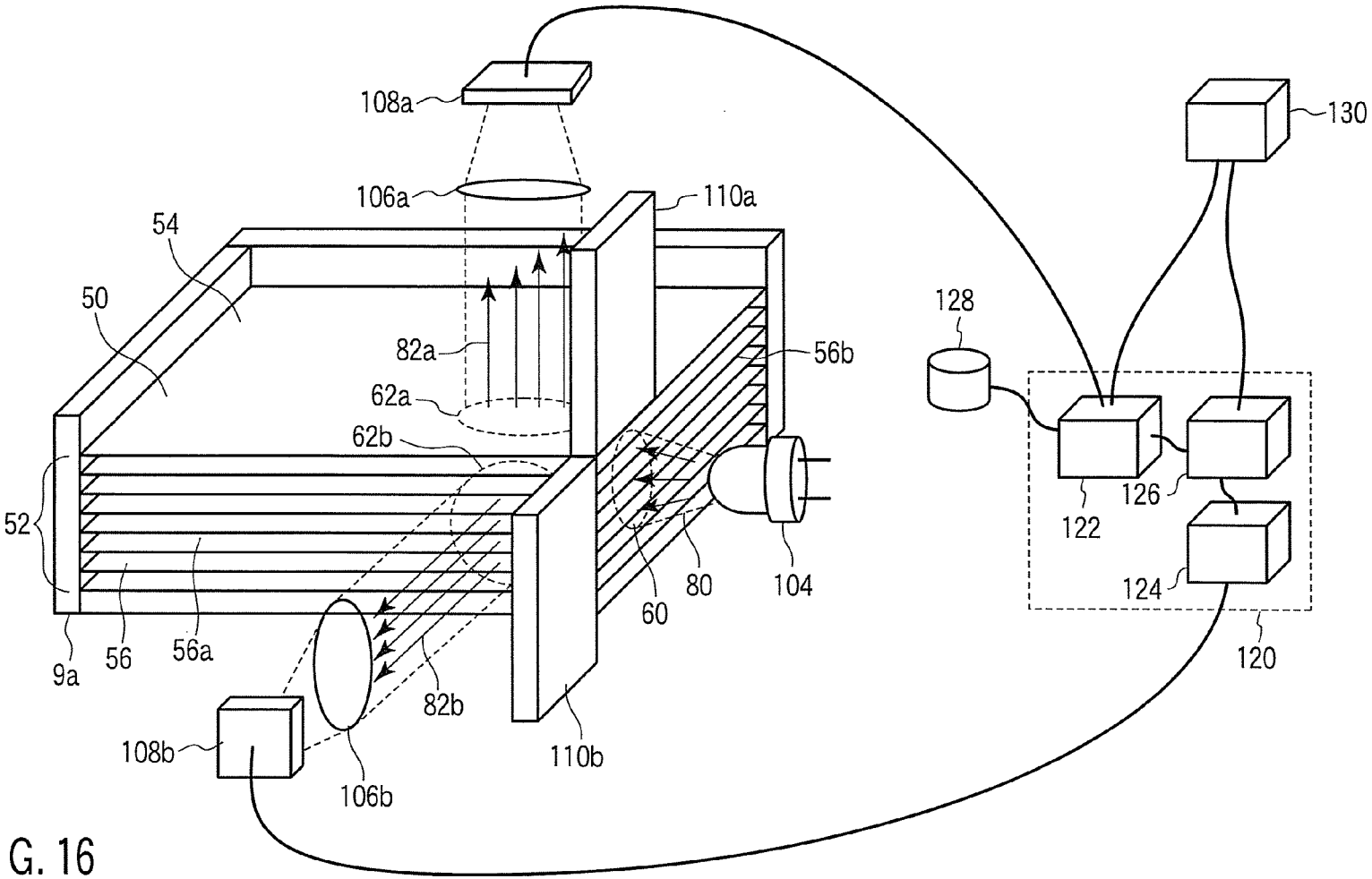
FIG. 16 is a schematic diagram showing a sheet type determination apparatus according to a sixth embodiment.

FIG. 16 schematically shows the arrangement of the sheet type determination apparatus according to a sixth embodiment.

As shown in FIG. 16, a sheet bundle 52 is placed in sheet feed tray 9*a*. The light source 104 is arranged opposite the side surface 56*b* of the sheet bundle 52, and applies illumination light 80 to the first region 60 on the side surface 56*b* of the sheet bundle 52. From the first region 60, the illumination light 80 enters the sheet bundle 52. The illumination light 80 then propagates in the sheet bundle 52. A focusing lens 106*a* and a light-receiving element 108*a* are arranged opposite the second region 62*a* on the upper surface 54 of the sheet bundle 52. Further, a focusing lens 106*b* and a light-receiving element 108*b* are arranged opposite the third region 62*b* of the side surface 56*a* of the sheet bundle 52, which is different from the side surface 56*b* thereof. Still further, a light blocking member 110*a* is arranged between the light source 104 and the light-receiving element 108*a*, and a light blocking member 110*b* is arranged between the light source 104 and the light-receiving element 108*b*. The light blocking members 110*a* and 110*b* do not allow passage of light, hence preventing the light coming directly from the light source 104 and the light reflected by the side surface 56*b* of the sheet bundle 52 from reaching the light-receiving elements 108*a* and 108*b*, respectively.

The light-receiving element 108*a* measures the light intensity distribution of the transmitted light 82*a* emerging from the second region 62*a* on the upper surface 54 of the sheet bundle 52 after passing through the sheet bundle 52. The data representing this light intensity distribution is transmitted to the sheet type determination unit 122. The sheet type determination unit 122 calculates the attenuation rate of the transmitted light from the light intensity distribution data received from the light-receiving element 108*a*. The sheet type determination unit 122 then refers to the database 128, thereby determining the type of the sheet 50 and the density thereof.

The light-receiving element 108*b* measures the light intensity distribution of the transmitted light 82*b* emerging from the third region 62*b* on the side surface 56*a* of the sheet bundle 52, after passing through the sheet bundle 52. The data representing this light intensity distribution is transmitted to the sheet thickness determination unit 124. The sheet thickness determination unit 124 calculates the thickness of the sheets 50 based on the light intensity distribution data received from the light-receiving element 108*b*. The grammage calculation unit 126 multiplies the density of the sheet 50, determined by the sheet type determination unit 122, by the thickness of the sheet 50, calculated by the sheet thickness calculation unit 124, thereby calculating the grammage of the sheet 50.

In the sixth embodiment, the attenuation rate can be accurately calculated by measuring the light intensity distribution of the transmitted light 82*a* emerging from the upper surface 54 of the sheet bundle 52, not influenced the unevenness in the light intensity resulting from the edge of each sheet 50 and the gap between any adjacent sheets 50. In addition, the thickness of the sheet 50 can be calculated by measuring the light intensity distribution of the transmitted light 82*b* emerging from the side surface 56*a* of the sheet bundle 52. The data about the sheet 50 acquired is more correct than in the case where the light intensity distribution is measured at only the upper surface 54 or the side surface 56 of the sheet bundle 52.

The first region 60 may be set in the same surface as the second region 62*a* or the third region 62*b*, so far as it does not overlap the second region 62*a* or the third region 62*b*. If this is the case, the light blocking members 110 are so arranged that the light-receiving elements 108 detect neither the light directly applied from the light source 104 nor the light reflected at the surface of any sheet.

(Seventh Embodiment)

Figure 17:
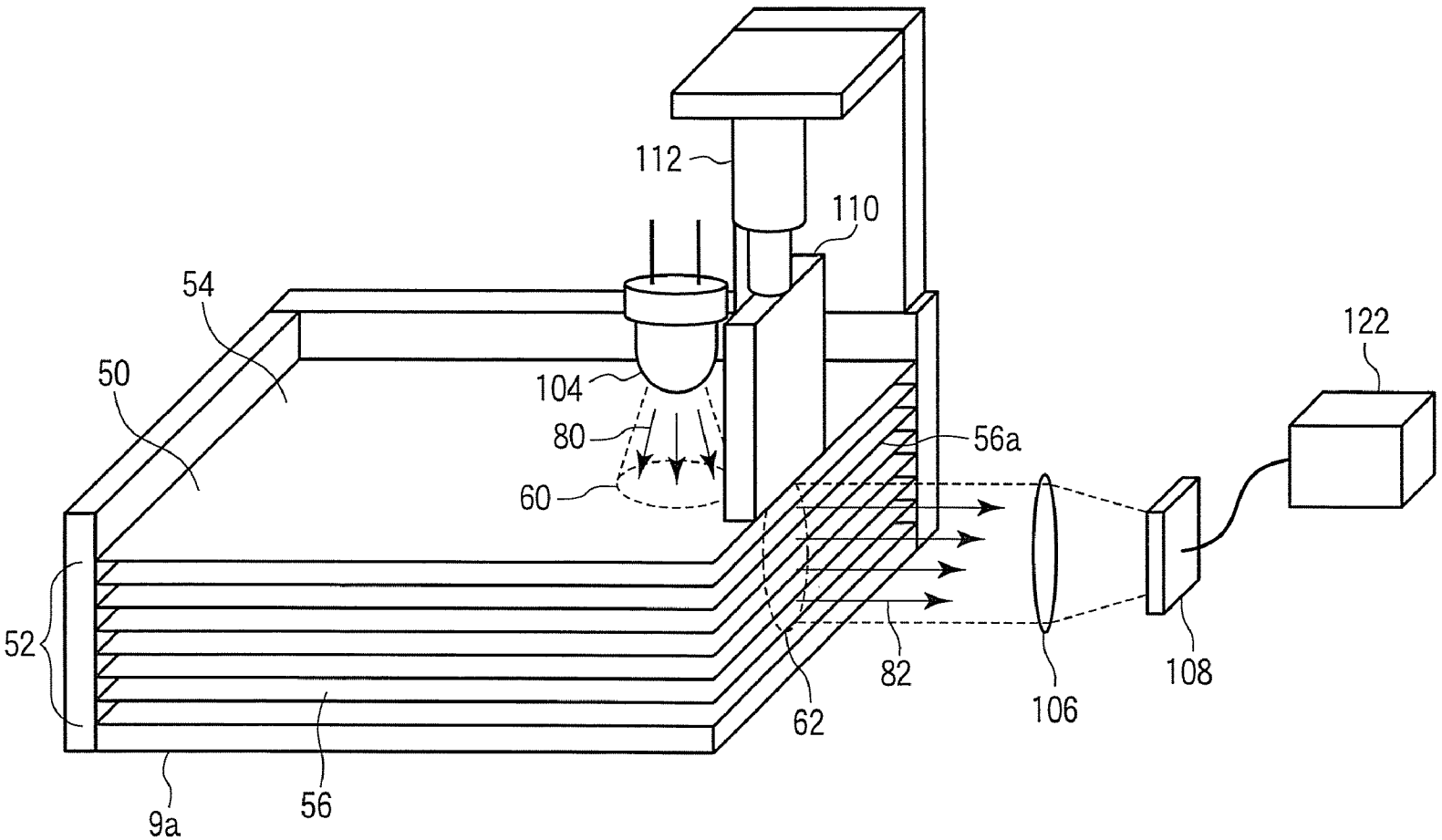
FIG. 17 is a schematic diagram showing a sheet type determination apparatus according to a seventh embodiment.

FIG. 17 schematically shows the arrangement of a sheet type determination apparatus according to a seventh embodiment.

As shown in FIG. 17, a sheet bundle 52 is placed in the sheet feed tray 9*a*. The light blocking member 110 is arranged on the sheet bundle 52, and blocks the light applied directly or indirectly from the light source 104 to the light-receiving element 108. On sheet feed tray 9*a*, a pushing unit 112 that is driven by a pneumatic actuator is provided so as to contact the top of the light blocking member 110. The pushing unit 112 can change the position of the light blocking member 110, upward and downward, pushing the sheet bundle 52 to reduce gaps between the sheets 50.

In the seventh embodiment, the pushing unit 112 pushes the sheet bundle 52, narrowing gaps between the sheets 50 and reducing the light intensity of light leaking through the gaps. Therefore, the unevenness in the light intensity distribution of the transmitted light emitted from the side surfaces 56 of the sheet bundle 52 is reduced. As a result, the noise at the attenuation curve of light intensity, acquired from the light intensity distribution of the transmitted light 82, can be reduced.

Figure 18:
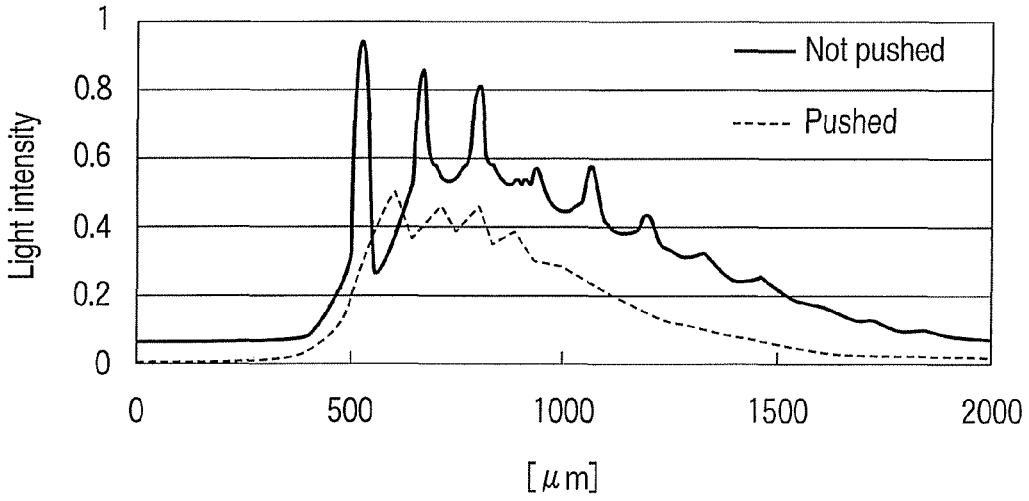
FIG. 18 is a graph showing a light intensity distribution observed if the pushing unit pushes a sheet bundle and a light intensity distribution observed if the pushing unit does not push a sheet bundle, in comparison with each other.

FIG. 18 shows a light intensity distribution observed if the sheet bundle 52 is pushed and a light intensity distribution observed if the sheet bundle 52 is not pushed, in comparison with each other. If the sheet bundle 52 is not pushed, the light intensity will have clear peaks resulting from the light leaking through the gaps between the sheets 50, as shown in FIG. 18. Consequently, the attenuation curve representing how the light is attenuated while passing through the sheets 50 is indefinite. By contrast, if the sheet bundle 52 is pushed, the attenuation curve has small peaks and is definite.

In this embodiment, the light intensity distribution of the transmitted light 82 may be imaged, while not pushing the sheet bundle 52, and the thickness of one sheet 50 may be calculated. Then, the light intensity distribution of the transmitted light 82 may be imaged, while the pushing unit 112 is pushing the sheet bundle 52, and the attenuation rate of the transmitted light may be calculated.

The intensity of the transmitted light may be measured while not pushing the sheet bundle 52, and also while pushing the sheet bundle 52, and the difference between the resultant two intensities of the transmitted light may be calculated. The peaks observed in the light intensity distribution are thereby made definite, and the thickness of the sheet 50 may be calculated from these peaks.

As described above, the pushing unit 112 is arranged on the top of the light blocking member 110. Nonetheless, the arrangement of the pushing unit 112 is not limited to this, so far as the pushing unit 112 can push the sheet bundle. For example, the pushing unit 112 may be configured to perform the function of the light blocking member 110, as well.

As indicated above, too, the pushing unit 112 is driven by a pneumatic actuator. Nevertheless, it can be driven by any other device, such as a hydraulic actuator, an electric motor, a piezoelectric element, so long as it achieve a similar advantage.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet type determination apparatus comprising:

a tray configured to hold a sheet bundle formed by sheets which are stacked, the sheet bundle comprising an upper surface, a lower surface and a plurality of side surfaces extending in a stacking direction;

a light source configured to emit illumination light to a first region on at least one first surface selected from the side surfaces;

a first detection unit configured to detect a first light intensity distribution of first transmitted light emerging from a second region on at least one second surface selected from the upper surface and the lower surface, the first transmitted light being generated as the illumination light which passes through the sheet bundle, and the second region being different from the first region;

a database configured to store a table describing a relation between reference attenuation rates and sheet types; and a sheet type determination unit configured to calculate an attenuation rate of the first transmitted light based on the first light intensity distribution, and determine a type of the sheets by comparing the attenuation rate with the reference attenuation rates.

2. The apparatus according to claim 1, further comprising a light blocking member configured to block the illumination light applied directly to the first detection unit and light which is reflected at the first region and then applied to the first detection unit.

3. The apparatus according to claim 1, further comprising a pushing unit configured to push the sheet bundle in a direction to narrow gaps between the sheets.

4. The apparatus according to claim 1, further comprising:

a second detection unit configured to detect a second light intensity distribution of second transmitted light emerging from a third region on at least one third surface selected from the side surfaces, the second transmitted light being generated as the illumination light which passes through the sheet bundles, and the third region being different from the first region;

a sheet thickness calculation unit configured to calculate a thickness of respective sheets based on the second light intensity distribution, wherein the table further describes a relation between the reference attenuation rates and densities of sheets, and the sheet type determination unit determines a density of the sheets by referring to the reference attenuation rates in the table with the calculated attenuation rate; and a grammage calculation unit configured to calculate a grammage of the sheets by multiplying the determined density of the sheets by the calculated thickness of the respective sheets.

5. The apparatus according to claim 1, wherein the first light intensity distribution is a two-dimensional light intensity distribution, and the sheet type determination unit generates a one-dimensional light intensity distribution based on the two-dimensional light intensity distribution and calculates the attenuation rate of the first transmitted light based on the one-dimensional light intensity distribution.

6. The apparatus according to claim 5, wherein the sheet type determination unit calculates the one-dimensional light intensity distribution in a first direction by integrating the second-dimensional light intensity distribution in a second direction perpendicular to the first direction.

7. The apparatus according to claim 5, wherein the sheet type determination unit calculates an attenuation rate which minimizes a residual sum of squares for the one-dimensional light intensity distribution and an attenuation curve including, as a parameter, the attenuation rate.

8. The apparatus according to claim 1, wherein the first light intensity distribution is a one-dimensional light intensity distribution.

9. An image formation apparatus comprising:

the sheet type determination apparatus according to claim 1;

an image formation unit configured to form images on the sheets; and a control unit configured to control the image formation unit in accordance with the type of the sheets.

10. A sheet type determination method for use in a sheet determination apparatus which comprises a tray configured to hold a sheet bundle formed by sheets which are stacked, the sheet bundle comprising an upper surface, a lower surface and a plurality of side surfaces extending in a stacking direction, a light source configured to emit illumination light to a first region on at least one first surface selected from the side surfaces, and a database configured to store a table describing a relation between reference attenuation rates and sheet types, the method comprising;

detecting a light intensity distribution of transmitted light emerging from a second region on at least one second surface selected from the upper surface and the lower surface, the transmitted light being generated as the illumination light passes through the sheet bundle, and the second region being different from the first region;

calculating an attenuation rate of the transmitted light based on the light intensity distribution; and determining the type of the sheets by referring to the reference attenuation rates in the table with the calculated attenuation rate.

* * * * *